US007026273B2

(12) United States Patent
Robson et al.

(10) Patent No.: US 7,026,273 B2
(45) **Date of Patent: *Apr. 11, 2006**

(54) LUBRICATING OIL COMPOSITIONS

(75) Inventors: Robert Robson, Abingdon (GB); Roger W. Glyde, Bampton (GB); Alisdair J. Brown, Abingdon (GB); Simon S. M. Chung, Witney (GB); Stephen Arrowsmith, Didcot (GB)

(73) Assignee: Infineum International Limited, (GB)

( * ) Notice: Subject to any disclaimer, the term of this patent is extended or adjusted under 35 U.S.C. 154(b) by 179 days.

This patent is subject to a terminal disclaimer.

(21) Appl. No.: 10/277,440

(22) Filed: Oct. 22, 2002

(65) Prior Publication Data

US 2003/0148895 A1 Aug. 7, 2003

(30) Foreign Application Priority Data

Nov. 9, 2001 (EP) ..... 01309510
Jan. 14, 2002 (EP) ..... 02250224

(51) Int. Cl.
*C10M 141/12* (2006.01)

(52) U.S. Cl. ..... 508/156; 508/159; 508/185; 508/186; 508/189; 508/192; 508/197; 508/198; 508/363; 508/364; 508/518

(58) Field of Classification Search ..... 508/185, 508/156
See application file for complete search history.

(56) References Cited

U.S. PATENT DOCUMENTS

| | | | | |
|---|---|---|---|---|
| 4,634,543 | A * | 1/1987 | Okada et al. | 252/78.5 |
| 6,060,437 | A * | 5/2000 | Robson et al. | 508/371 |
| 6,451,745 | B1 * | 9/2002 | Ward | 508/192 |
| 6,500,786 | B1 * | 12/2002 | Hartley et al. | 508/365 |
| 6,569,818 | B1 * | 5/2003 | Nakazato et al. | 508/185 |
| 6,605,572 | B1 * | 8/2003 | Carrick et al. | 508/198 |
| 6,617,286 | B1 * | 9/2003 | Sato et al. | 508/192 |
| 6,730,638 | B1 * | 5/2004 | Farng et al. | 508/194 |

FOREIGN PATENT DOCUMENTS

| | | |
|---|---|---|
| EP | 0 280 579 A2 | 8/1988 |
| EP | 0 737 735 A2 | 10/1996 |
| EP | 0 562 172 B1 | 3/1999 |
| EP | 1 016 706 A2 | 7/2000 |
| EP | 1 167 497 A2 | 1/2002 |
| WO | WO96/06904 | 3/1996 |
| WO | WO96/37582 | 11/1996 |
| WO | WO02/062930 | 8/2002 |

* cited by examiner

*Primary Examiner*—Ellen M. McAvoy

(57) ABSTRACT

A crankcase lubricating oil composition comprises an oil of lubricating viscosity, in a major amount, and, in respective minor amounts, a boron-containing additive and one or more co-additives, wherein the lubricating oil composition has greater than 200 ppm by mass of boron, less than 600 ppm by mass of phosphorus and less than 4000 ppm by mass of sulfur, based on the mass of the oil composition. Such compositions demonstrate provide improved wear performance.

27 Claims, No Drawings

LUBRICATING OIL COMPOSITIONS

This invention relates to lubricating oil compositions, more especially to compositions suitable for use in piston engine, especially gasoline (spark-ignited) and diesel (compression-ignited), crankcase lubrication. Such compositions may be referred to as crankcase lubricants.

Most of the moving parts of an internal combustion engine are in a state of hydrodynamic lubrication, but, some sliding parts, such as pistons and valve trains, are in a mixed or boundary lubrication state. To provide wear resistance caused by friction in these lubrication states, it has been necessary to provide the engine oil with additives to reduce wear. For many years, zinc dialkyldithiophosphates ("ZDDPs") have been used as standard antiwear additives.

A problem arising from the use of ZDDPs is their phosphorus content: phosphorus derivatives deriving from the ZDDPs can poison the components of exhaust gas catalytic converters. Catalytic converters are used to reduce pollution and to meet governmental regulations requiring reduction in the levels of undesirable gases, such as hydrocarbons, carbon monoxide, and oxides of nitrogen, from internal engine combustion exhaust emissions. Such converters use catalysts which are installed in the exhaust streams, e.g. the exhausts of automobiles, to treat the undesirable gases. Phosphorus derivatives, such as decomposition products of ZDDPs, can be carried into the exhaust, where they are believed to poison the catalyst. Accordingly, the use of engine oils containing phosphorus additives may substantially reduce the life and effectiveness of catalytic converters. Therefore, it would be desirable to reduce, or eliminate, the phosphorus-content of engine oils so as to maintain the activity and extend the life of catalytic converters. Also, it is possible that sulfur-containing components may poison the catalysts, for example those used to reduce the levels of oxides of nitrogen.

Governmental and automotive industry pressure to reduce the phosphorus and sulfur content of lubricating oil compositions therefore exists. However, if this were done, for example by reducing the level of ZDDP, the anti-wear performance of the lubricating oil composition would be lessened. The art has addressed this problem in a number of ways, for example:

- WO 96/37582 describes a lubricating oil composition comprising a sulfoxymolybdenum dithiocarbamate, a zinc dialkyldithiophosphate, and a defined proportion of calcium and magnesium salicylate, wherein the amount of molybdenum derived from the molybdenum compound is 200 to 1000 ppm, the amount of phosphorus derived from the zinc compound is 0.04 to 0.15 mass %, and the amount of the metal salicylates is 0.5 to 10 mass %.
- EP-A-0 280 579 and EP-A-0 280 580 describe lubricating oil compositions with reduced or zero amounts of zinc and phosphorus, which comprise 5 to 500 ppm of copper in oil-soluble form, one or more sulfur-containing compounds providing 0.5 to 2.0 mass % of sulfur and a bearing corrosion inhibitor.
- EP-A-0 609 623, U.S. Pat. No. 5,629,272 and EP-A-0 814 148 describe oil compositions comprising a metal-containing detergent, a ZDDP and a boron-containing ashless dispersant, characterised in that the compositions further comprise an antiwear agent having an aliphatic amide and either a dithiocarbamate compound or an ester of a fatty acid and boric acid.

It has now been surprisingly found, according to this invention, that certain levels of boron can endow crankcase lubricating oil compositions with satisfactory anti-wear performance, even oil compositions with low levels of both phosphorus and sulfur.

Accordingly, in a first aspect, the invention provides a crankcase lubricating oil composition comprising, or made by admixing, an oil of lubricating viscosity in a major amount, and, in respective minor amounts, a boron-containing additive and one or more co-additives, wherein the lubricating oil composition has greater than 200 ppm by mass of boron, less than 600 ppm by mass of phosphorus and less than 4000, ppm by mass of sulfur, based on the mass of the oil composition.

In a second aspect, the invention provides a crankcase lubricating oil composition comprising, or made by admixing, an oil of lubricating viscosity in a major amount, and, in respective minor amounts, a boron-containing additive and one or more co-additives, wherein the lubricating oil composition has greater than 300 ppm by mass of boron, less than 900 ppm by mass of phosphorus and less than 4000, ppm by mass of sulfur, based on the mass of the oil composition.

In a third aspect, the invention provides a crankcase lubricating oil composition comprising, or made by admixing, an oil of lubricating viscosity in a major amount, and, in respective minor amounts, a boron-containing additive, a detergent additive composition and one or more co-additives, wherein the lubricating oil composition has greater than 150 ppm by mass of boron, less than 800 ppm by mass of phosphorus and less than 4000, ppm by mass of sulfur, based on the mass of the oil composition, provided that the detergent additive composition comprises at least two detergents of at least two metals.

In a fourth aspect, the invention provides an additive composition comprising, or made by admixing, a diluent or carrier oil, a boron-containing additive and one or more co-additives in such proportions so to provide a crankcase lubricating oil composition having greater than 200 ppm or boron, less than 600 ppm by mass of phosphorus and less than 4000, by mass ppm by mass of sulfur, based on the mass of the oil composition, when the oil composition contains 2 to 20 mass % of the additives.

In a fifth aspect, the invention provides an additive composition comprising, or made by admixing, a diluent or carrier oil, a boron-containing additive and one or more co-additives in such proportions so to provide a crankcase lubricating oil composition having greater than 300 ppm by mass of boron, less than 900 ppm by mass of phosphorus and less than 4000, by mass ppm by mass of sulfur, based on the mass of the oil composition, when the oil composition contains 2 to 20 mass % of the additives.

In a sixth aspect, the invention provides an additive composition comprising, or made by admixing, a diluent or carrier oil, a boron-containing additive, a detergent additive composition comprising at least two detergents of at least two metals and one or more co-additives in such proportions so to provide a crankcase lubricating oil composition having greater than 150 ppm by mass of boron, less than 800 ppm by mass of phosphorus and less than 4000, ppm by mass of sulfur, based on the mass of the oil composition, when the oil composition contains 2 to 20 mass % of the additives.

In a seventh aspect, the invention provides a method for conferring wear resistance (anti-wear properties) to a crankcase lubricating oil composition that contains less than 900 ppm by mass of phosphorus and less than 4000, ppm by mass of sulfur, based on the mass of the oil composition, by provision in the oil composition of a boron-containing additive to provide greater than 50 ppm by mass of boron based on the mass of the oil composition.

In an eighth aspect, the invention provides a method of lubricating the crankcase of a spark-ignited or a compression-ignited internal combustion engine which comprises supplying to the engine a lubricating oil composition according to the first, second or third aspect of the invention.

In a ninth aspect, the invention provides the use of an effective amount of a boron-containing additive in a crankcase lubricating oil composition that contains less than 900 ppm by mass of phosphorus and less than 4000 ppm by mass of sulfur, based on the mass of the oil composition, to provide wear resistance, in particular in the Peugeot TU3M Scuffing Test and/or Sequence IVA Test. An effective amount is preferably an amount sufficient to provide at least 50 ppm by mass of boron based on mass of the oil composition.

In a tenth aspect, the invention provides the use of an effective amount of a boron-containing additive and an effective amount of a molybdenum-containing additive in a lubricating oil composition that contains less than 900 ppm by mass of phosphorus and less than 4000 ppm by mass of sulfur, based on the mass of the oil composition, to provide friction-reducing performance and/or anti-oxidancy performance to the oil composition.

In this specification:

"Major amount" means in excess of 50 mass % of the composition.

"Minor amount" means less than 50 mass % of the composition, both in respect of the stated additive and in respect of the total mass % of all of the additives present in the composition, reckoned as active ingredient of the additive or additives.

"Comprises or comprising" or cognate words are taken to specify the presence of stated features, steps, integers, or components, but do not preclude the presence or addition of one or more other features, steps, integers, components or groups thereof.

"TBN" is Total Base Number as measured by ASTM D2896.

"Oil-soluble" or "oil-dispersible" does not necessarily indicate that the additives are soluble, dissolvable, miscible or capable of being suspended in the oil of lubricating viscosity, in all proportions. They do mean, however, that they are, for example, soluble or stably dispersible in the oil to an extent sufficient to exert their intended effect in the environment in which the oil is employed. Moreover, the additional incorporation of other additives may also permit incorporation of higher levels of a particular additive, if desired.

"ppm" means parts per million, expressed by mass based on the mass of the lubricating oil composition.

"substantially" means an amount, for example, of a compound, which is less than that required to provide a technical effect from that compound; preferably the amount is fully zero.

The abbreviation SAE stands for Society of Automotive Engineers.

All percentages reported are mass % on an active ingredient basis, i.e., without regard to carrier or diluent oil, unless otherwise stated.

It should be noted that the lubricating oil compositions of this invention comprise defined individual, i.e., separate, components that may or may not remain the same chemically before and after mixing. Thus, it will be understood that various components of the composition, essential as well as optional and customary, may react under the conditions of formulation, storage or use, and that the invention also provides the product obtainable or obtained as a result of any such reaction.

The features of the present invention will now be discussed in more detail.

Crankcase Lubrication Oil Composition

The amount of phosphorus, sulfur, boron or molybdenum in the lubricating oil composition is measured according to ASTM D5185.

The amount of phosphorus in the lubricating oil composition, independently of the amount of sulfur or boron, with respect to the first or fourth aspect of the invention is preferably less than 550, more preferably less than 500, such as less than 400, especially less than 300 or 200, advantageously less than 100, ppm, based on the mass of the oil composition. More preferably, it is zero.

The amount of phosphorus in the lubricating oil composition, independently of the amount of sulfur or boron, with respect to the second, fifth, seventh, ninth or tenth aspect of the invention is preferably less than 800 or 700, more preferably less than 600 or 550, such as less than 500 or 400, especially less than 300 or 200, advantageously less than 100, ppm, based on the mass of the oil composition. More preferably, it is zero.

The amount of phosphorus in the lubricating oil composition, independently of the amount of sulfur or boron, with respect to the third or sixth aspect of the invention is preferably less than 700, more preferably less than 600 or 550, such as less than 500 or 400, especially less than 300 or 200, advantageously less than 100, ppm, based on the mass of the oil composition. More preferably, it is zero.

The amount of sulfur in the lubricating oil composition, independently of the amount of phosphorus or boron, with respect to each aspect of the invention is preferably at most 3000, more preferably at most 2500, ppm by mass, based on the mass of the oil composition; especially the amount of sulfur is at most 2000, or at most 1500, ppm by mass; advantageously the amount of sulfur is less than 1000, or less than 700, ppm. In an embodiment, the amount of sulfur is less than 500 ppm, preferably the amount of sulfur is zero.

Typically, the phosphorus in the oil composition is derived from a phosphorus-containing additive, such as a ZDDP that may be present. The sulfur can be derived from the oil of lubricating viscosity, such as Group I, II or III basestock; the diluent oil or carrier oil, which is used as a carrier fluid for the additive components and additive compositions; and any sulfur-containing additives, for example, ZDDPs and sulfonate detergents. In an embodiment of each aspect of the present invention, the defined amount of phosphorus is in respect of the amount of phosphorus derived from ZDDP that is present.

The amount of boron, independently of the amount of sulfur or phosphorus, with respect to the first or fourth aspect is preferably greater than 250, for example, greater than 300, ppm, based on the mass of the oil composition; more preferably the amount of boron is greater than any one of 400, 500, 600, 700, 800 or 900, ppm; especially the amount of boron is greater than any one of 1000, 1100, 1200, 1500 or 2000, ppm. Advantageously the amount of boron does not exceed 10,000, preferably not greater than 7500, more preferably not greater than 5000, such as not greater than 3000, ppm, based on the mass of the oil composition.

The amount of boron, independently of the amount of sulfur or phosphorus, with respect to the second or fifth aspect is preferably greater than 350, for example, greater than 400, ppm, based on the mass of the oil composition;

more preferably the amount of boron is greater than any one of 500, 600, 700, 800 or 900, ppm; especially the amount of boron is greater than any one of 1000, 1100, 1200, 1500 or 2000, ppm. Advantageously the amount of boron does not exceed 10,000, preferably not greater than 7500, more preferably not greater than 5000, such as not greater than 3000, ppm, based on the mass of the oil composition.

The amount of boron, independently of the amount of sulfur or phosphorus, with respect to the third, sixth, seventh, ninth or tenth aspect is preferably greater than 175, for example, greater than 200, ppm, based on the mass of the oil composition; more preferably the amount of boron is greater than any one of 300, 400, 500, 600, 700, 800 or 900, ppm; especially the amount of boron is greater than any one of 1000, 1100, 1200, 1500 or 2000, ppm. Advantageously the amount of boron does not exceed 10,000, preferably not greater than 7500, more preferably not greater than 5000, such as not greater than 3000, ppm, based on the mass of the oil composition.

Typically, the boron in the oil composition is derived from a boron-containing additive.

In an embodiment of each aspect of the invention, a copper-containing compound, such as a copper carboxylate, is substantially absent or a zinc dithiocarbamate is substantially absent.

In an embodiment of each aspect of the invention, a molybdenum-containing additive, for example a molybdenum dithiocarbamate is present in the oil composition, then the amount of molybdenum in the oil composition is, independently of the amount of boron, phosphorus and sulfur, at most 1000, preferably at most 750, more preferably at most 500, such as at most 400, especially in the range 300 to 50, advantageously in the range 75 to 275, more advantageously in the range 100 to 250, ppm by mass, based on the mass of the oil composition.

It has been found that the combination of a boron-containing additive and a molybdenum-containing additive in appropriate amounts in a crankcase lubricating oil composition provides improved friction-reducing and anti-oxidancy performance to the oil composition.

In a preferred embodiment of each aspect of the invention, the lubricating oil composition has less than 1.5, especially less than 1.3, advantageously in the range of 0.01 to 1.0, such as in the range from 0.5 to 0.8, mass % of sulfated ash, according to the method ASTM D874.

Preferably, the lubricating oil composition is a multigrade identified by the viscometric descriptor SAE15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 10WX, SAE 5WX or SAE 0WX, preferably in the form of an SAE 5WX or SAE 0WX, wherein X represents any one of 20, 30, 40 and 50. Preferably X is 20 or 30.

The lubricating oil compositions of each aspect of the invention are suitable for lubricating an internal combustion engine, such as a passenger car engine or a heavy duty diesel engine. Examples of passenger car engines are light duty diesel engines and gasoline engines.

Preferably, the heavy duty diesel engines, according to the present invention, are used in land-based vehicles, preferably large road vehicles, such as large trucks. The road vehicles typically have a weight greater than 12 tonnes. The engines used in such vehicles tend to have a total displacement of at least 6.5, preferably at least 8, more preferably at least 10, such as at least 15, liters; engines having a total displacement of 12 to 20 liters are preferred. Generally, engines having a total displacement greater than 24 liters are not considered land-based vehicles. The engines according to the present invention also have a displacement per cylinder of at least 1.0 or at least 1.5, such as at least 1.75, preferably at least 2, liters per cylinder. Generally, heavy duty diesel engines in road vehicles have a displacement per cylinder of at most 3.5, such as at most 3.0; preferably at most 2.5, liters per cylinder.

As used herein, the terms 'total displacement' and 'displacement per cylinder' are known to those skilled in the art of internal combustion engines (see "Diesel Engine Reference Book", edited by B. Challen and R. Baranescu, second edition, 1999, published by SAE International). Briefly, the term "displacement' corresponds to the volume of the cylinder in the engine as determined by the piston movement and consequently the "total displacement" is the total volume dependent on the number of cylinders; and the term 'displacement per cylinder' is the ratio of the total displacement to the number of cylinders in the engine.

Thus, in an aspect, the present invention provides a combination of a heavy duty diesel engine in a land-based vehicle which engine has a total displacement of at least 6.5 liters and a displacement per cylinder of at least 1.0 liter per cylinder and a lubricating oil composition as defined in any one of the first, second or third aspect.

The American Petroleum Institute (API), Association des Constructeur Europeén d'Automobile (ACEA) and Japanese Standards Organisation (JASO) specify the performance level required for lubricating oil compositions. Also there are performance specifications known as Global, which contains tests and performance levels from ACEA, API and JASO specifications.

Thus, a heavy duty lubricating oil composition of the present invention preferably satisfies at least the performance requirements of heavy duty diesel engine lubricants, such as at least the API CG-4; preferably at least the API CH-4; especially at least the API CI-4. In another embodiment, the lubricating oil composition of the invention, independently of meeting the API performance requirements, preferably satisfies at least the ACEA E2-96; more preferably at least the ACEA E3-96; especially at least ACEA E4-99; advantageously at least the ACEA E5-99. In a further embodiment, the lubricating oil composition of the invention, independently of meeting the API and ACEA performance requirements, preferably satisfies the JASO DH-1 or Global DHD-1.

In respect of a passenger car engine, such as a gasoline or diesel engine, lubricating oil composition, the lubricating oil composition preferably satisfies at least the performance requirements of API SH; more preferably at least the API SJ; especially at least the API SL. In another embodiment, the lubricating oil composition of the invention, independently of meeting the API performance requirements, preferably satisfies at least the ACEA A2-96 (issue 2), more preferably at least the ACEA A3-98, especially at least the ACEA A1-98, for gasoline engines; and at least ACEA B2-98, more preferably at least the ACEA B1-98, such as at least the ACEA B3-98, especially at least the ACEA B4-98, for light duty diesel engines.

Oil of Lubricating Viscosity

The oil of lubricating viscosity or lubricating oil can be a synthetic or mineral oil of lubricating viscosity selected from the group consisting of Group I, II, III, IV and V basestocks, and a mixture containing any two or more thereof.

Basestocks may be made using a variety of different processes including but not limited to distillation, solvent refining, hydrogen processing, oligomerization, esterification, and rerefining.

API 1509 "Engine Oil Licensing and Certification System" Fourteenth Edition, December 1996 states that all basestocks are divided into five general categories:

Group I basestocks contain less than 90% saturates and/or greater than 0.03% sulfur and have a viscosity index greater than or equal to 80 and less than 120;

Group II basestocks contain greater than or equal to 90% saturates and less than or equal to 0.03% sulfur and have a viscosity index greater than or equal to 80 and less than 120;

Group III basestocks contain greater than or equal to 90% saturates and less than or equal or 0.03% sulfur and have a viscosity index greater than or equal to 120;

Group IV basestocks contain polyalphaolefins (PAO); and

Group V basestocks contain include all other basestocks not included in Group I, II, III or IV.

Group IV basestocks, i.e., polyalphaolefins (PAO), include hydrogenated oligomers of an alpha-olefin, the most important methods of oligomerization being free radical processes, Ziegler catalysis, cationic and Friedel-Crafts catalysis.

Preferably the lubricating oil is selected from any one of Group I to V basestocks and mixtures thereof.

Especially preferred is any one of Group I, III, IV or V basestock or a mixture containing any two or more thereof, or a mixture of Group IV basestock with 5 to 80 mass % of Group I, II, III or V basestock.

The test methods used in defining the above groups are ASTM D2007 for saturates; ASTM D2270 for viscosity index; and one of ASTM D2622, 4294, 4927 and 3120 for sulfur.

Boron-Containing Additive

Boron-containing additives may be prepared by reacting a boron compound with an oil-soluble or oil-dispersible additive or compound. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids.

Examples of boron-containing additives include a borated dispersant; a borated dispersant VI improver; an alkali metal or a mixed alkali metal or an alkaline earth metal borate; a borated overbased metal detergent; a borated epoxide; a borate ester; a sulfurised borate ester; and a borate amide.

Borated dispersants may be prepared by boration of succinimide, succinic ester, benzylamine and their derivatives, each of which has an alkyl or alkenyl group of molecular weight of 700 to 3000. Processes for manufacture of these additives are known to those skilled in the art. A preferred amount of boron contained in these dispersants is 0.1 to 5 mass % (especially 0.2 to 2 mass %). A particularly preferable borated dispersant is a succinimide derivative of boron, for example borated polyisobutenyl succinimide.

Alkali metal and alkaline earth metal borates are generally hydrated particulate metal borates, which are known in the art. Alkali metal borates include mixed alkali and alkaline earth metal borates. These metal borates are available commercially. Representative patents describing suitable alkali metal and alkaline earth metal borates and their methods of manufacture include U.S. Pat. Nos. 3,997,454; 3,819,521; 3,853,772; 3,907,601; 3,997,454; and 4,089,790.

Boron-containing additives include borated fatty amines. The borated amines may be prepared by reacting one or more of the above boron compounds with one or more of fatty amines, e.g., an amine having from four to eighteen carbon atoms. They may be prepared by reacting the amine with the boron compound at a temperature in the range of from 50 to 300, preferably from 100 to 250° C., and at a ratio from 3:1 to 1:3 equivalents of amine to equivalents of boron compound.

Borated fatty epoxides are generally the reaction product of one or more of the above boron compounds with at least one epoxide. The epoxide is generally an aliphatic epoxide having from 8 to 30, preferably from 10 to 24, more preferably from 12 to 20, carbon atoms. Examples of useful aliphatic epoxides include heptyl epoxide and octyl epoxide. Mixtures of epoxides may also be used, for instance commercial mixtures of epoxides having from 14 to 16 carbon atoms and from 14 to 18 carbon atoms. The borated fatty epoxides are generally known and are described in U.S. Pat. No. 4,584,115.

Borate esters may be prepared by reacting one or more of the above boron compounds with one or more alcohols of suitable oleophilicity. Typically, the alcohols contain from 6 to 30, or from 8 to 24, carbon atoms. The methods of making such borate esters-are known in the art.

The borate esters can be borated phospholipids. Such compounds, and processes for making such compounds, are described in EP-A-0 684 298.

Examples of sulfurised borated esters are also known in the art: see EP-A-0 285 455 and U.S. Pat. No. 6,028,210.

Borated overbased metal detergents are known in the art where the borate substitutes the carbonate in the core either in part or in full.

In an embodiment of each aspect, a preferred boron-containing additive is a borated dispersant, for example, a borated polyisobutenyl succinimide wherein the average number molecular weight ($\overline{M}n$) of the polybutenyl backbone is in the range from 700 to 1250.

In another embodiment of each aspect, a borate ester is substantially absent in the compositions of the present invention.

Detergent Additive Composition

In appropriate aspects of the invention, for example the first, second, fourth, fifth, seventh, and ninth aspects, a detergent additive composition, which comprises one or more detergents, may be provided in the lubricating oil composition.

A detergent is an additive that reduces formation of piston deposits, for example high-temperature varnish and lacquer deposits, in engines; it has acid-neutralising properties and is capable of keeping finely divided solids in suspension. It is usually based on metal "soaps", that is metal salts of acidic organic compounds, sometimes referred to as surfactants. Organic acids useful in present invention typically have one or more functional groups, such as OH or COOH or $SO_3H$, and a hydrocarbyl substituent. Examples of organic acids include sulfonic acids, phenols and sulfurised derivatives thereof, and carboxylic acids. The metal detergent may be neutral or overbased, which terms are known in the art.

The detergent additive composition may comprise one or more neutral detergents or one or more overbased detergents or a mixture thereof.

The metals are preferably selected from Group 1 and Group 2 metals, e.g., sodium, potassium, lithium, calcium, and magnesium.

Preferably the detergent additive composition, in respect of each aspect of the invention, comprises a metal salt of an aromatic carboxylic acid, for example a salicylate-based detergent, such as calcium salicylate. It is particularly preferred that the detergent additive composition comprises more than 50 mole % of a metal salt of an aromatic carboxylic acid, based on the moles of the metal salts of organic acids in the detergent composition. More preferably the proportion of the metal salt of an aromatic carboxylic acid is at least 60 or at least 70 mole %; more preferably at least 80 or at least 90 mole %, based on the moles of the metal salts of organic acids in the detergent additive composition.

In a most preferred embodiment, the detergent additive composition comprises 100 mole % of a metal salt of an aromatic carboxylic acid, based on the moles of the metal salts of organic acids in the detergent composition, that is the detergent additive composition comprises only aromatic carboxylic acids as the organic acids.

Preferred examples of aromatic carboxylic acids are salicylic acids and sulphurised derivatives thereof, such as hydrocarbyl substituted salicylic acid and derivatives thereof. Especially preferred are salicylic acids.

With respect to any one of the first, second, fourth, fifth, seventh or ninth aspect, in an embodiment, the detergent additive composition comprises one or more detergents of the same metal, for example calcium or magnesium, preferably calcium; more preferably the detergents are of different surfactant types, such as calcium salicylate and calcium sulfonate. In another embodiment, the detergent additive composition comprises at least two detergents of at least different two metals, for example a neutral or overbased magnesium detergent and at least one other metal detergent, e.g., a neutral or overbased calcium detergent and/or neutral or overbased sodium detergent.

Preferred detergent additive compositions in respect of each aspect of the invention comprise a mixture of calcium and magnesium detergents.

Detergent additive compositions comprising only salicylate detergents, whether neutral or overbased, are particularly advantageous.

Surfactants that may also be used include aliphatic carboxylates; sulfonates; phenates, non-sulfurised or sulfurised; thiophosphonates; and naphthenates.

Also suitable in each aspect of the present invention is a detergent in the form of a hybrid complex detergent, wherein the basic material is stabilised by more than one type of surfactant. It will be appreciated by one skilled in the art that a single type of organic acid may contain a mixture of organic acids of the same type. For example, a sulphonic acid may contain a mixture of sulphonic acids of varying molecular weights. Such an organic acid composition is considered as one type. Thus, complex detergents are distinguished from mixtures of two or more separate overbased detergents, an example of such a mixture being one of an overbased calcium salicylate detergent with an overbased calcium phenate detergent.

The art describes examples of overbased complex detergents. For example, International Patent Application Publication Nos. 9746643/4/5/6 and 7 describe hybrid complexes made by neutralising a mixture of more than one acidic organic compound with a basic metal compound, and then overbasing the mixture. Individual basic micelles of the detergent are thus stabilised by a plurality of surfactant types.

EP-A-0 750 659 describes a calcium salicylate phenate complex made by carboxylating a calcium phenate and then sulfurising and overbasing the mixture of calcium salicylate and calcium phenate. Such complexes may be referred to as "phenalates"

The proportion of one surfactant to another in a complex detergent is not critical.

Preferred complex detergents are salicylate-based detergents, for example, "phenalates" and salicylate-based detergents disclosed in any one of International Patent Application Publication Nos. 9746643/4/5/6 and 7.

The detergents, whether complex or not, can have a Total Base Number (TBN) in the range of 15 or 60 to 600, preferably 100 to 450, more preferably 160 to 400.

When the detergent additive composition consists of metal salicylate detergents, it is preferred that the salicylate is either calcium salicylate or a mixture of calcium and magnesium salicylates. More preferably, at least one or each metal salicylate detergent is overbased. When both calcium and magnesium salicylates are present, more calcium salicylate than magnesium salicylate is preferably be present, based on the mass of the respective metals.

When the detergent additive composition comprises two or more metal detergents of different surfactant types, it is preferred that the detergents. have the same metal, for example, calcium.

As an example, the total amount of metal derived from the metal detergents in the lubricating oil composition is at most 2700 ppm, based on the mass of the oil composition. Suitable methods for measuring the total metal content are well known in the art and include X-ray fluorescence and atomic absorption spectrometry.

Means for determining the amount of metal salt of an organic acid (e.g., an aromatic carboxylic acid) are known to those skilled in the art. For example, a skilled person can calculate the amounts in the final lubricating oil composition from information concerning the amount of raw materials (e.g., organic acids) used to make the detergent(s) and from information concerning the amount of detergent(s) used in the final oil composition.

Analytical methods (e.g., potentiometric titration and chromatography) can also be used to determine the amounts of metal salts of organic acid (e.g., in the case of a metal sulphonate, ASTM D3712 may be used to determine the metal associated with the sulphonate).

It will be appreciated by a skilled person in the art that the methods to determine the amount of metal salts of organic acids (also known as surfactants), including the amount of metal salts of aromatic carboxylic acids, are at best approximations and that differing methods will not always give exactly the same result; they are, however, sufficiently precise to allow the practice of the present invention.

Molybdenum-Containing Additive

The oil-soluble or oil-dispersible molybdenum molubdenum-containing additive comprises one or more oil-soluble or oil-dispersible molybdenum compounds. In a preferred embodiment, the molybdenum compound is a molybdenum-sulfur compound.

The molybdenum-sulfur compounds useful in the present invention may be mononuclear or polynuclear. In the event that the compound is polynuclear, the compound contains a molybdenum core consisting of non-metallic atoms, such as sulfur, oxygen and selenium, preferably consisting essentially of sulfur.

To enable the molybdenum-sulfur compound to be oil-soluble or oil-dispersible, one or more ligands are bonded to a molybdenum atom in the compound. The bonding of the ligands includes bonding by electrostatic interaction as in the case of a counter-ion and forms of bonding intermediate between covalent and electrostatic bonding. Ligands within the same compound may be differently bonded. For example, a ligand may be covalently bonded and another ligand may be electrostatically bonded.

Preferably, the or each ligand is monoanionic and examples of such ligands are dithiophosphates, dithiocarbamates, xanthates, carboxylates, thioxanthates, phosphates and hydrocarbyl, preferably alkyl, derivatives thereof. Preferably, the ratio of the number of molybdenum atoms, for example, in the core in the event that the molybdenum-sulfur compound is a polynuclear compound, to the number of monoanionic ligands, which are capable of rendering the compound oil-soluble or oil-dispersible, is greater than 1 to 1, such as at least 3 to 2.

The molybdenum-sulfur compound's oil-solubility or oil-dispersibility may be influenced by the total number of carbon atoms present among all of the compound's ligands. The total number of carbon atoms present among all of the hydrocarbyl groups of the compound's ligands typically will be at least 21, e.g. 21 to 800, such as at least 25, at least 30 or at least 35. For example, the number of carbon atoms in each alkyl group will generally range between 1 to 100, preferably 1 to 40, and more preferably between 3 and 20.

Examples of molybdenum-sulfur compounds include dinuclear molybdenum-sulfur compounds and trinuclear molybdenum-sulfur compounds.

An example of a dinuclear molybdenum-sulfur compound is represented by the formula:

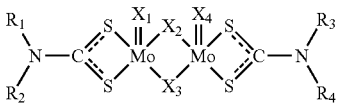

where $R_1$ to $R_4$ independently denote a straight chain, branched chain or aromatic hydrocarbyl group having 1 to 24 carbon atoms; and $X_1$ to $X_4$ independently denote an oxygen atom or a sulfur atom. The four hydrocarbyl groups, $R_1$ to $R_4$, may be identical or different from one another.

In a preferred embodiment, the molybdenum-sulfur compound is an oil-soluble or oil-dispersible trinuclear molybdenum-sulfur compound. Examples of trinuclear molybdenum-sulfur compounds are disclosed in WO98/26030, WO99/31113, WO99/66013, EP-A-1 138 752, EP-A-1 138 686 and European patent application no. 02078011, each of which are incorporated into the present description by reference, particularly with respect to the characteristics of the molybdenum compound or additive disclosed therein.

Preferably the molybdenum-sulfur compound has a core of the structures depicted in (I) or (II):

(I)

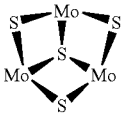

or

-continued (II)

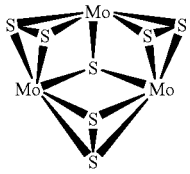

Each core has a net electrical charge of +4.

Preferably, the trinuclear molybdenum-sulfur compounds are represented by the formula $MO_3S_kE_xL_nA_pQ_z$, wherein:

k is an integer of at least 1;

E represents a non-metallic atom selected from oxygen and selenium;

x can be 0 or an integer, and preferably k+x is at least 4, more preferably in the range of 4 to 10, such as 4 to 7, most preferably 4 or 7;

L represents a ligand that confers oil-solubility or oil-dispersibility on the molybdenum-sulfur compound, preferably L is a monoanionic ligand;

n is an integer in the range of 1 to 4;

A represents an anion other than L, if L is an anionic ligand;

p can be 0 or an integer;

Q represents a neutral electron-donating compound; and z is in the range of 0 to 5 and includes non-stoichiometric values.

Those skilled in the art will realise that formation of the trinuclear molybdenum-sulfur compound will require selection of appropriate ligands (L) and other anions (A), depending on, for example, the number of sulfur and E atoms present in the core, i.e. the total anionic charge contributed by sulfur atom(s), E atom(s), if present, L and A, if present, must be −12.

Examples of Q include water, alcohol, amine, ether and phosphine. It is believed that the electron-donating compound, Q, is merely present to fill any vacant coordination sites on the trinuclear molybdenum-sulfur compound.

Examples of A can be of any valence, for example, monovalent and divalent and include disulfide, hydroxide, alkoxide, amide and, thiocyanate or derivative thereof; preferably A represents a disulfide ion.

Preferably, L is monoanionic ligand, such as dithiophosphates, dithiocarbamates, xanthates, carboxylates, thioxanthates, phosphates and hydrocarbyl, preferably alkyl, derivatives thereof. When n is 2 or more, the ligands can be the same or different.

In an embodiment, independently of the other embodiments, k is 4 or 7, n is either 1 or 2, L is a monoanionic ligand, p is an integer to confer electrical neutrality on the compound based on the anionic charge on A and each of x and z is 0.

In a further embodiment, independently of the other embodiments, k is 4 or 7, L is a monoanionic ligand, n is 4 and each of p, x and z is 0.

In another embodiment, the molybdenum-containing additive comprises trinuclear molybdenum core and bonded thereto a ligand, preferably a mono-anionic ligand, such as a dithiocarbamate, capable of rendering the core oil-soluble or oil-dispersible. For the avoidance of doubt, the molybdenum-containing additive may also comprise either negatively charged molybdenum species or positively charged molybdenum species or both negatively and positively charged molybdenum species.

The molybdenum-sulfur cores, for example, the structures depicted in (I) and (II) above, may be interconnected by means of one or more ligands that are multidentate, i.e. a ligand having more than one functional group capable of binding to a molybdenum atom, to form oligomers. Molybdenum-sulfur additives comprising such oligomers are considered to fall within the scope of this invention.

Other examples of molybdenum compounds include molybdenum carboxylates and molybdenum nitrogen complexes, both of which may be sulfurised.

Further co-additives may be present to meet particular requirements. Examples of such include viscosity index improvers, corrosion inhibitors, detergents other than those mentioned, metal rust inhibitors, pour point depressants, anti-foaming agents, dispersants other than those mentioned, anti-wear agents, oxidation inhibitors or anitoxidants, and friction modifiers.

In respect of appropriate aspects of the invention, for example, the fourth, fifth and sixth aspects, the preparation of an additive composition is a convenient method of adding the additives to a lubricating oil in order to yield a lubricating oil composition. The amount of additives in the final lubricating oil composition is generally dependent on the type of the oil composition, for example, a heavy duty diesel engine lubricating oil composition preferably has 7 to 20, more preferably 8 to 16, such as 8 to 14, mass % of additives, based on the mass of the oil composition. A passenger car engine lubricating oil composition, for example, a gasoline or a diesel engine oil composition, tends to have a lower amount of additives, for example 2 to 10, such as 3 or 4 to 10, preferably 3 to 9, especially 6 to 8, mass % of additives, based on the mass of the oil composition.

The present invention is illustrated by, but in no way limited to, the following examples.

EXAMPLES

Four crankcase lubricating oil compositions, each satisfying the 5W30 viscosity grade, were prepared by methods known in the art. Two, Examples 1 and 2, are examples of the invention, and two, Examples A and B, are comparative examples. The compositional details of the examples are shown in Table 1.

TABLE 1

| Elemental Content (ppm by mass) | Ex. A | Ex. B | Ex. 1 | Ex. 2 |
|---|---|---|---|---|
| Boron[1] | 1 | 0 | 1180 | 770 |
| Phosphorus[2] | 0 | 500 | 0 | 0 |
| Calcium[3] | 2260 | 2370 | 2220 | 2240 |
| Magnesium[4] | 390 | 380 | 380 | 380 |
| Sulfur[5] | 690 | 1505 | 620 | 630 |

Key:
[1]= derived from borated dispersant;
[2]= derived from ZDDP;
[3]= derived from calcium salicylate detergent;
[4]= derived from magnesium salicylate detergent; and
[5]= derived from diluent or carrier oil and basestock; and in Example B, also from ZDDP.

The sulfated ash content of each composition in Table 1 is on or about 1 mass %. In all other relevant respects, the four compositions are comparable.

Each composition was tested for its wear performance in the Peugeot TU3M Scuffing Test, according to CEC-L-38-A-94, and Sequence IVA Test, according to RR:D02-1473. The results are in Table 2 below.

TABLE 2

| | Comparative Examples | | Examples | |
|---|---|---|---|---|
| | Ex. A | Ex. B | Ex. 1 | Ex. 2 |
| Peugeot TU3 | | | | |
| Pad Merit (Limit - 7.5 min.) | 2.5 | 6.8 | 9 | 7.5 |
| Cam Average (Limit - 10 max.) | 65 | 4.1 | 5.8 | 4.9 |
| Cam Maximum (Limit - 15 max.) | 97.5 | 5.5 | 8.5 | 6.3 |
| Overall Result | Fail | Fail | Pass | Pass |
| Sequence IVA | | | | |
| Cam Average (Limit - 120 max.) | 409.17 | 169.43 | 43.77 | 42.54 |
| Overall Result | Fail | Fail | Pass | Pass |

Table shows that superior wear results are obtained by inclusion of boron at broadly similar sulfur levels and in the absence of phosphorus, i.e., comparing the results for Examples 1 and 2 with those for Example A. They also show that inclusion of boron gives rise to better overall wear results than a boron-free composition containing higher levels of both phosphorus and sulfur, i.e. comparing the results for Examples 1 and 2 with those for Example B.

Multigrade crankcase lubricating oil compositions comprising a boron-containing additive and, optionally a molybdenum-containing additive were also prepared by methods known in the art. Examples C to G are comparative examples and Examples 3 to 6 are examples of the invention. The compositional details of the oil compositions are shown in Table 3.

The oil compositions were tested for anti-oxidancy and friction-reducing performance: see Table 3 for the results.

It can be seen from Table 3 that Examples C to E, each of which contained no molybdenum but an incrementally increasing amount of boron from about 300 to about 900 ppm, did not show any improvement in anti-oxidancy. Similar observations are noted for Examples F, G and Example 3, each of which contained about 100 ppm of molybdenum and an incrementally increasing amount of boron from about 300 to about 900 ppm. In contrast, a surprising improvement in the anti-oxidancy behaviour is observed in Examples 4 to 6, each of which contained a higher comparable amount of molybdenum, when the amount of boron is incrementally increased from about 300 to about 900 ppm.

Table 3 also shows the friction-reducing performance of the oil compositions. Examples C to E demonstrated comparable performance although the amount of boron is incrementally increased from about 300 to about 900 ppm. A similar trend is apparent for Examples F and G, but Example 3 containing about 900 ppm of boron and about 100 ppm of molybdenum showed an improvement in friction-reduction. Examples 4 to 6 demonstrated better friction-reducing behaviour as the amount of boron is increased from about 300 to about 900 ppm while the amount of molybdenum is kept constant at a higher comparable amount. In particular, it has been noted, in Examples 4 to 6, that the induction period for the formation of the low co-efficient of friction films is reduced as the amount of boron is increased and thus leading to a better friction performance.

The anti-oxidancy and friction-reducing performance of the oil compositions suggest that there is a synergy between the boron-containing additive and molybdenum-containing additive dependent on the amount of elemental boron and elemental molybdenum in the oil composition.

TABLE 3

| Elemental Content (ppm by mass) | Ex. C | Ex. D | Ex. E | Ex. F | Ex. G | Ex. 3 | Ex. 4 | Ex. 5 | Ex. 6 |
|---|---|---|---|---|---|---|---|---|---|
| Boron[1] | 281 | 587 | 899 | 280 | 586 | 915 | 305 | 632 | 968 |
| Phosphorus[2] | 0 | 0 | 0 | 0 | 0 | 0 | 0 | 0 | 0 |
| Calcium[3] | 2190 | 2140 | 2140 | 2180 | 2160 | 2190 | 2310 | 2190 | 2220 |
| Magnesium[4] | 410 | 380 | 462 | 383 | 384 | 411 | 404 | 386 | 389 |
| Molybdenum[6] | 0 | 0 | 0 | 109 | 105 | 104 | 284 | 275 | 274 |
| Oxidation, CHP[a] | 0.25 | 0.25 | 0.21 | 0.36 | 0.40 | 0.41 | 0.61 | 0.81 | 0.93 |
| Friction[b], average friction @ 140° C., μ | 0.15 | 0.16 | 0.15 | 0.15 | 0.15 | 0.09 | 0.10 | 0.07 | 0.05 |

Key:
[1], [2], [3] and [4]as for Table 1 above;
[6]= derived from trinuclear molybdenum additive;
[a]= amount of Cumene Hydroperoxide (CHP) degraded at 125° C. for one hour, in millimoles of CHP degraded per gram of oil, is an indicator of the oxidation potential of the oil; and
[b]= High Frequency Reciprocating Rig operated over 30 minutes.

The sulfated ash content of each of the oil composition (Ex. C to G and Ex. 3 to 6) is less than 1%; the sulfur content, d the basestock and diluent, of each of the oil compositions is less than 1150 ppm by mass; and in all other relevant respects the oil compositions are comparable.

What is claimed is:

1. A crankcase lubricating oil composition comprising, or made by admixing, an oil of lubricating viscosity, in a major amount, and, in respective minor amounts, a boron-containing additive, a detergent additive composition and one or more co-additives, wherein the lubricating oil composition has greater than 600 ppm by mass of boron, less than 200 ppm by mass of phosphorus and less than 4000 ppm by mass of sulfur, based on the mass of the oil composition.

2. The composition as claimed in claim 1, wherein the composition further comprises, or is made by further admixing, a molybdenum-containing additive in a minor amount.

3. The composition as claimed in claim 1, wherein said detergent additive composition comprises at least two detergents of at least two metals.

4. The composition as claimed in claim 1, wherein the boron-containing additive is selected from a borated dispersant, a borated dispersant VI improver, an alkali metal or a mixed alkali metal or an alkaline earth metal borate, a borated overbased metal detergent, a borated epoxide, a sulfurised borate ester, and a borate amide.

5. The composition as claimed in claim 1, wherein said composition is an SAE 10WX or SAE 5WX or SAE 0WX oil composition, where X represents any one of 20, 30 and 40.

6. The composition as claimed in claim 1 containing a salicylate-based detergent, in a minor amount.

7. The composition as claimed in claim 1, wherein the ash content of the composition is less than 1.5 mass % based on the mass of the composition, as measured according to ASTM D-874.

8. The composition as claimed in claim 1 containing a salicylate-based detergent, in a minor amount.

9. A method for conferring wear resistance to a crankcase lubricating oil composition that contains a detergent additive composition, less than 200 ppm by mass of phosphorus and less than 6000 ppm by mass of sulfur, based on the mass of the oil composition, by provision in the composition of a boron-containing additive to provide greater than 600 ppm by mass of boron based on the mass of the composition.

10. A method of lubricating the crankcase of a spark-ignited or a compression-ignited internal combustion engine which comprises supplying to the engine a lubricating oil composition as claimed in claim 1.

11. The composition, as claimed in claim 1, containing no greater than 400 ppm by mass of molybdenum, based on the mass of the oil composition.

12. The composition, as claimed in claim 11, no greater than 300 ppm by mass of molybdenum, based on the mass of the oil composition.

13. The method, as claimed in claim 9, wherein said lubricating oil composition contains no greater than 400 ppm by mass of molybdenum, based on the mass of the oil composition.

14. The method, as claimed in claim 13, wherein said lubricating oil composition containing no greater than 300 ppm by mass of molybdenum, based on the mass of the oil composition.

15. The composition as claimed in claim 1 having less than 100 ppm of phosphorus.

16. The composition as claimed in claim 1, wherein said composition is free of phosphorus.

17. The composition as claimed in claim 1 having greater than 1000 ppm of boron.

18. The composition as claimed in claim 17 having greater than 2000 ppm of boron.

19. The composition as claimed in claim 18 having from 700 to 10,000 ppm of boron.

20. The composition as claimed in claim 19 having from 700 to 3000 ppm of boron.

21. The composition as claimed in claim 1 having less than 1000 ppm of sulfur.

22. The composition as claimed in claim 21 having less than 500 ppm of sulfur.

23. The composition as claimed in claim 22 having less than 100 ppm of sulfur.

24. The composition as claimed in claim 1 wherein said composition is substantially free of copper-containing compounds.

25. The composition as claimed in claim 1 wherein said composition is substantially free of zinc dithiocarbamate.

26. The composition as claimed in claim 1, wherein said oil of lubricating viscosity is selected from the group consisting of Group II, III, IV and V basestocks, mixtures thereof, and mixtures of Group IV basestock and from 5 to 80 mass % of Group I, II, III or Group V basestock.

27. The composition as claimed in claim 1, wherein said composition has less than 100 ppm of phosphorus, greater than 600 ppm of boron, no greater than 300 ppm of molybdenum, less than 500 ppm of sulfur, is substantially free of copper-containing compounds and zinc dithiocarbamates and has ash content of the composition of less than 1.3 mass % based on the mass of the composition, and wherein said oil of lubricating viscosity is selected from the group consisting of Group II, III, IV and V basestocks, mixtures thereof, and mixtures of Group IV basestock and from 5 to 80 mass % of Group I, II, III or Group V basestock.

* * * * *